US005352096A

United States Patent [19]

Chi-Wen

[11] Patent Number: 5,352,096

[45] Date of Patent: Oct. 4, 1994

[54] AIR COMPRESSOR FOR AUTOMOBILES

[76] Inventor: Chen Chi-Wen, P.O. Box 82-144, Taipei, Taiwan

[21] Appl. No.: 127,015

[22] Filed: Sep. 27, 1993

[51] Int. Cl.[5] ..... F04B 49/06; F04B 49/08

[52] U.S. Cl. ..... 417/12; 417/290; 417/234; 417/279; 417/435; 417/44 G; 417/44.8

[58] Field of Search ..... 417/12, 234, 280, 290, 417/279, 292, 435, 44 R, 44 A, 44 G

[56] References Cited

U.S. PATENT DOCUMENTS

| | | | |
|---|---|---|---|
| 866,643 | 9/1907 | Glenn | 417/44 G |
| 1,018,594 | 7/1912 | Turner | 417/44 G |
| 1,037,039 | 8/1912 | Murphy | 417/44 G |
| 1,412,819 | 7/1922 | Aikman | 417/280 |
| 3,433,415 | 3/1969 | Enssle | 417/234 |
| 3,446,238 | 5/1969 | Wonstrud et al. | 416/44 G |
| 3,502,029 | 3/1970 | Halladay | 417/44 G |
| 4,009,971 | 3/1977 | Krohn ete al. | 417/43 |
| 4,068,980 | 1/1978 | Fine et al. | 417/290 |
| 4,397,610 | 8/1983 | Krohn | 417/44 A |
| 4,432,698 | 2/1984 | Shinakuma et al. | 417/290 |
| 5,052,894 | 10/1991 | Rimington | 417/234 |
| 5,292,732 | 3/1994 | Krohn et al. | 417/234 |

*Primary Examiner*—Richard A. Bertsch
*Assistant Examiner*—Peter Korytnyk
*Attorney, Agent, or Firm*—Alfred Lei

[57] ABSTRACT

This invention relates to an air compressor and in particular to one which includes a valve controlling device having a check valve and a cover. The check valve is fixedly mounted on said cover and is connected with a pipe. The check valve including a spring, a ball and a packing with the spring urging said ball against said packing thereby sealing said pipe. The cover is fixedly mounted on a cylinder so that air in said cylinder can flow out of said cover. A passage is formed between said cylinder and said cover and communicated with said check valve, a power breaker, an exhaust valve, and a pressure gauge. The power breaker is fixedly connected with said cover has via a connector and having an adjusting knob, a diaphragm, a main body, and two conducting members. The main body has an interior chamber in which is fitted a piston, the piston receiving a spring and having a protuberance on which is fitted a circular conductor. The spring urges the piston to go forward thereby pushing said circular conductor against the conducting members. An exhaust valve fixedly mounted on said cover and including a thermocouple and a needle valve. The exhausting device comprises an upper bakelite cover and a lower bakelite cover closedly engaged with the upper bakelite cover. The upper bakelite cover is provided with a locking member and an air outlet. The locking member is fitted with a seal ring and is formed with a hole into which is fitted the needle valve with the lower end contacting a heat sensitive member.

1 Claim, 5 Drawing Sheets

AIR COMPRESSOR FOR AUTOMOBILES

BACKGROUND OF THE INVENTION

It has been found that the prior art air compressor for automobiles in the marketplace utilizes a motor to drive a piston to compress air. However, when the compressor is turned on, it is necessary for the motor to drive the piston to overcome the air pressure of the tire and reciprocate in a cylinder thereby producing a relatively large transient current through the motor and therefore shortening its working life.

Therefore, it is an object of the present invention to provide an improved air compressor which may obviate and mitigate the above-mentioned drawbacks.

SUMMARY OF THE INVENTION

This invention relates to an improved air compressor for automobiles.

It is the primary object of the present invention to provide an air compressor for automobiles which can prevent the motor from being damaged.

It is another object of the present invention to provide an air compressor for automobiles which is equipped with a power breaker.

It is still another object of the present invention to provide an air compressor for automobiles which is equipped with a valve controlling device.

It is still another object of the present invention to provide an air compressor for automobiles which is equipped with an exhaust valve.

It is a further object of the present invention to provide an air compressor for automobiles which is practical in use.

Other objects and merits and a fuller understanding of the present invention will be obtained by those having ordinary skill in the art when the following detailed description of the preferred embodiment is read in conjunction with the accompanying drawings wherein like numerals refer to like or similar parts.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways.

Figure 1:
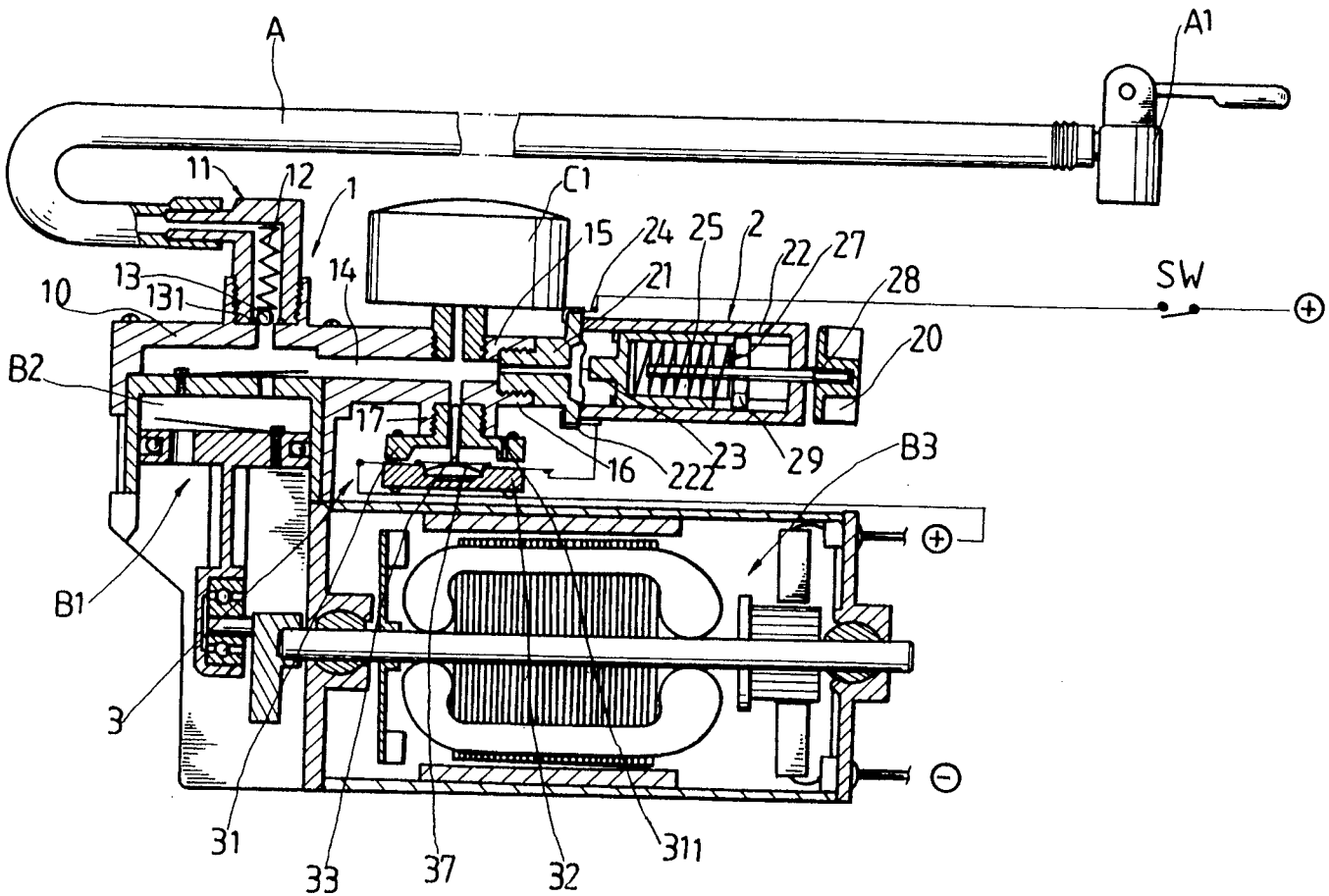
FIG. 1 is a sectional view of the present invention.

With reference to the drawings and in particular to FIG. 1 thereof, the air compressor according to the present invention mainly comprises a valve controlling device 1, a power breaker 2, and an exhaust device 3.

The valve controlling device 1 includes a check valve 11 and a cover 10. The check valve 11 is fixedly mounted on the cover 10 and is connected with a pipe A. Further, the check valve 11 comprises a spring 12, a ball 13, and a packing 131. The spring 12 urges the ball 13 against the packing 131 thereby sealing the pipe A. The cover 10 is fixedly mounted on a cylinder B2 so that the air in the cylinder B2 can flow out of the cover 10. In addition, between the cylinder B2 and the cover 10 there is a passage 14 which is communicated with the check valve 11, the power breaker 2, the exhaust valve 3, and the pressure gauge C1. The cover 10 is formed with a pressure gauge seat 15, a power breaker seat 16, and an exhaust valve seat 17.

Figure 2:
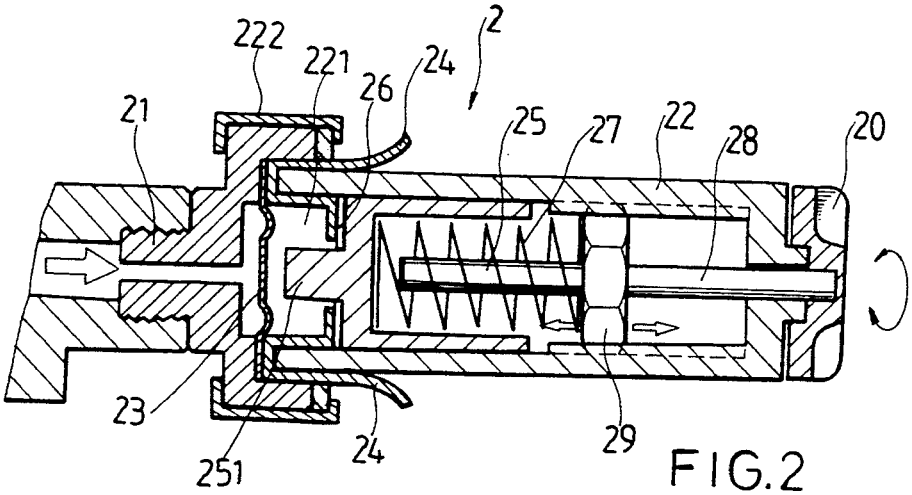
FIG. 2 is a sectional view of the power breaker.
Figure 3:
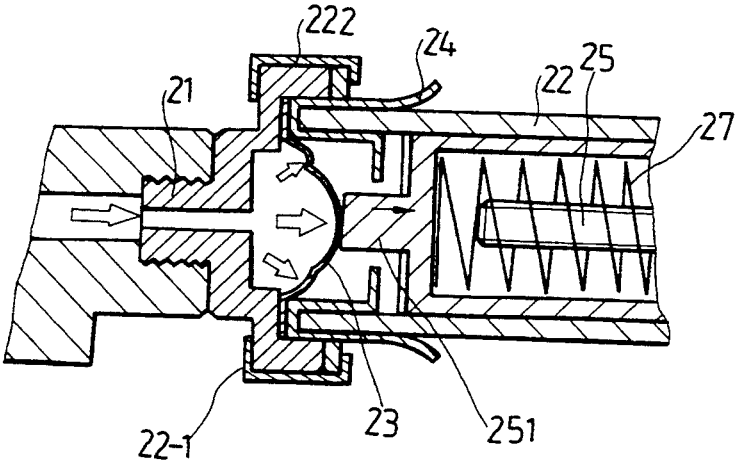
FIG. 3 is a sectional view showing the working principle of the power breaker.
Figure 4:
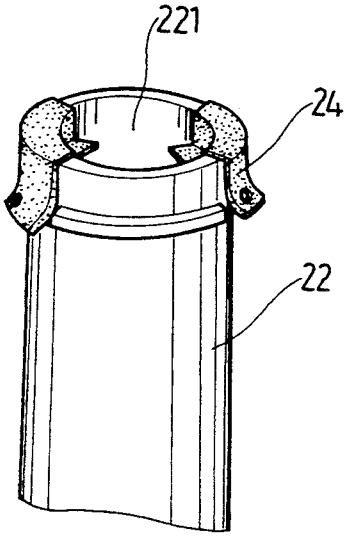
FIG. 4 shows the structure of the conductors of the power breaker.

As shown in FIGS. 2, 3 and 4, the power breaker 2 is fixedly connected with the cover 10 via a connector 21 and has an adjusting knob 20 at the end. The connector 21, a diaphragm 23, a main body 22, and two conducting members 24 are fixedly kept in place by a ring member 222. The main body 22 has an interior chamber 221 in which is fitted a piston 25. The piston 25 receives a spring 27 and has a protuberance 251 on which is fitted a circular conductor 26. Normally, the spring 27 urges the piston 25 to go forward thereby pushing the circular conductor 26 against the conducting members 24.

The other end of the spring 27 bears against a nut 29 on an adjusting rod 28 fixedly connected with the adjusting knob 20 so that when the adjusting knob 20 is rotated, the nut 29 will be moved along the adjusting rod 28 thus regulating the compression of the spring 27. As the air pressure is higher than pressure applied by the spring 27, the diaphragm 23 will expand as shown in FIG. 3 hence pushing the piston 25 to go inwards. As a consequence, the conducting members 24 are separated from the circular conductor 26 thus switching off the power.

Figure 5:
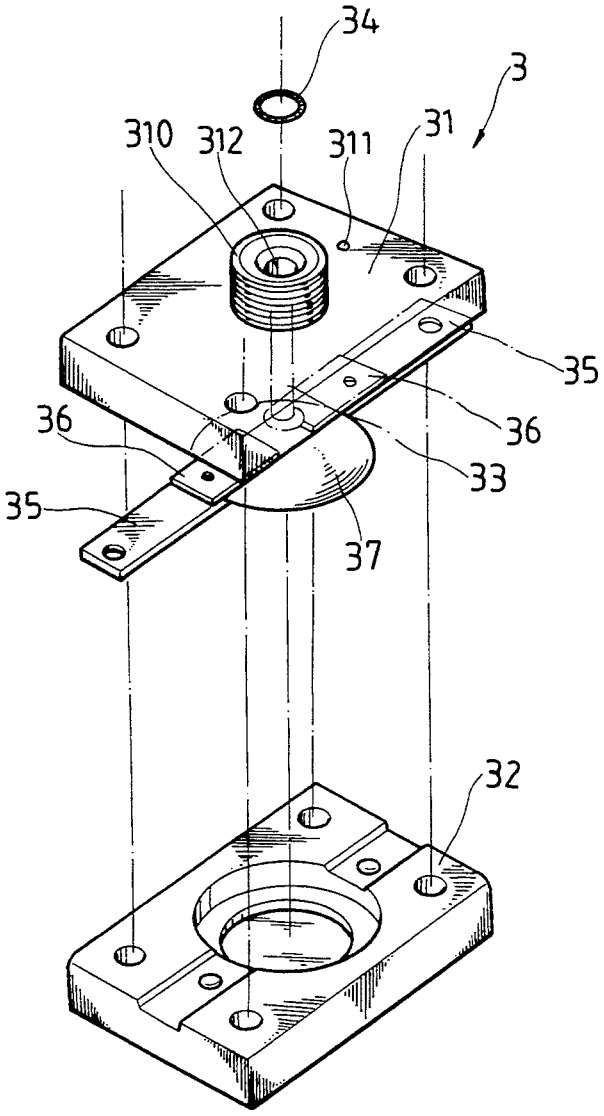
FIG. 5 an exploded view of the exhaust device.

As shown in FIG. 5, the exhaust device 3 is fixedly mounted on the cover 10 and includes a thermo-couple 36 and a needle valve 33. The exhaust device 3 includes an upper bakelite cover 31 and a lower bakelite cover 32 closedly engaged with the upper bakelite cover 31. The upper bakelite cover 31 is provided with a locking member 310 and an air outlet 311. The locking member 310 is tubular in shape and is fitted with a seal ring 34. Further, the locking member 310 is formed with a hole 312 in which is fitted a needle valve 33 with its lower end contacting a heat sensitive member 37.

Figure 6:
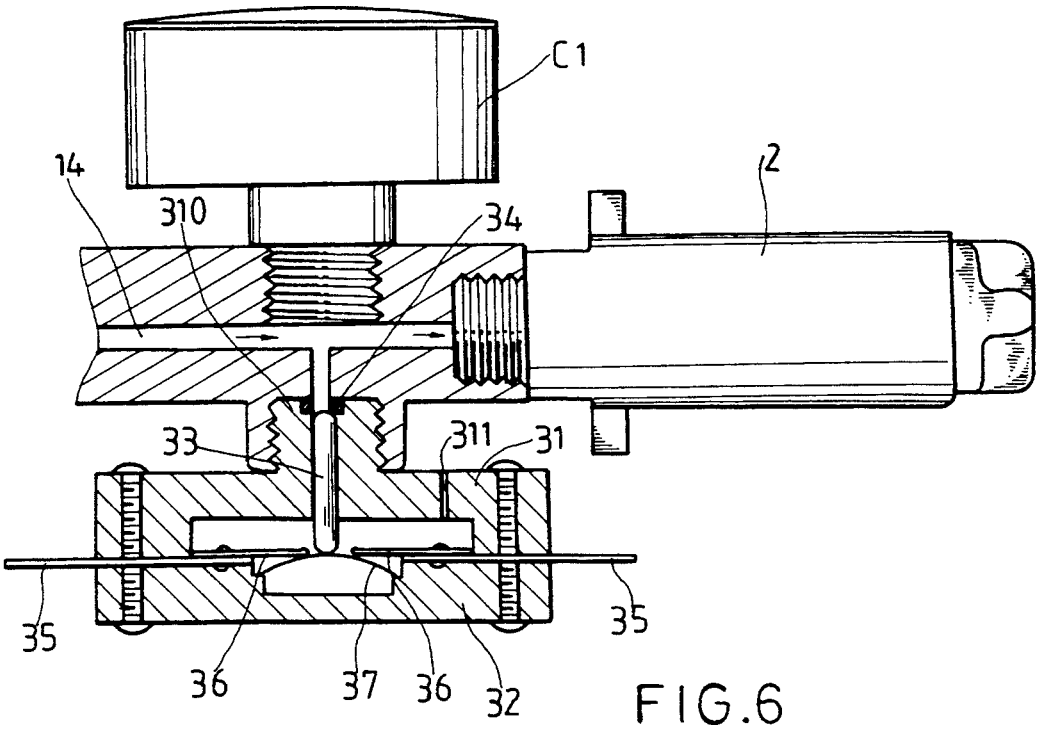
FIG. 6 is a sectional view of the exhaust device.
Figure 7:
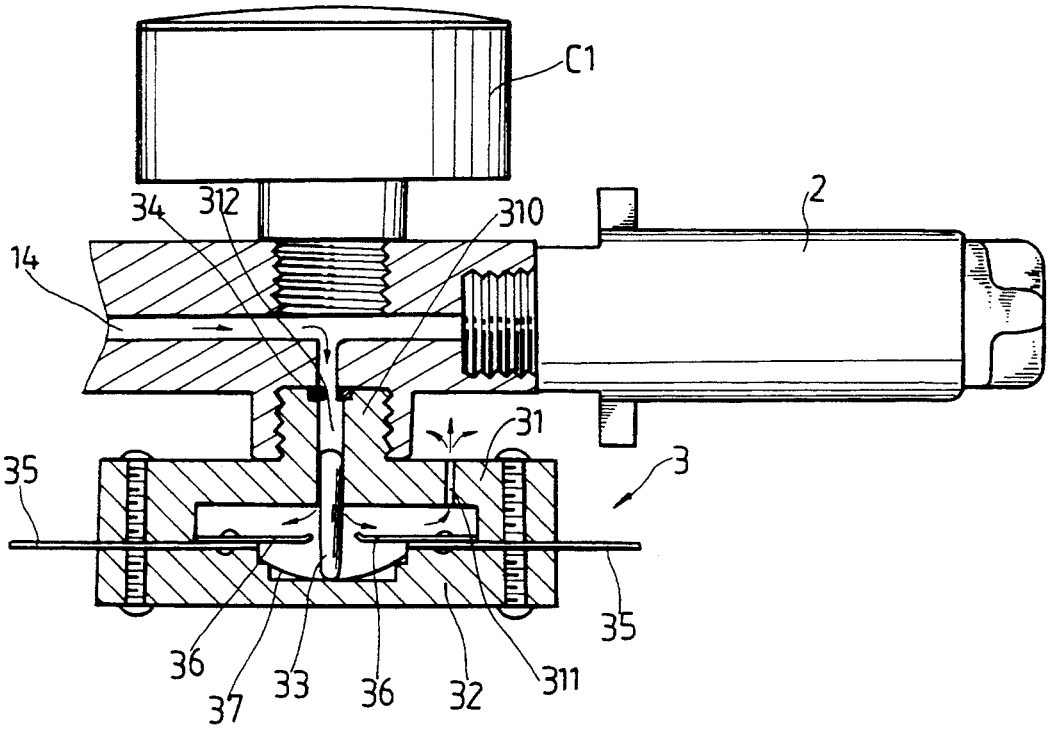
FIG. 7 shows the working principle of the exhaust device.

Looking now at FIGS. 6 and 7, the heat sensitive member 37 is in the shape of a disc and is disposed in the lower bakelite cover 32. When the heat sensitive member 37 will be in contact with the thermo-couple conducting plate 36 when curved downward so that the needle valve 33 will be pushed upward to seal the hole 312 of the locking member 30. A conducting steel plate 35 is riveted on the thermo-couple conducting plate 36. Normally, the thermo-couple conducting plate 36 is in contact with the heat sensitive member 37. When the motor is started and then stopped (the pipe A has not yet been disconnected from the tire), the pressure in the cylinder will be kept at a very high value. As it is necessary to start the motor again, the motor will require a relatively large amount of current in order to be able to oppose the internal pressure thereby requiring a large amount of electric current. Then, the electric current is converted to heat Which is transferred to the heat sensitive plate 37. In the meantime, the heat sensitive plate 37 concaves upward thus moving down the needle valve 33 and therefore opening the hole 312. Hence, the air can flow out of the air outlet 311 through the needle valve 3. Thereafter, as the air pressure is released through the outlet 311, the motor B3 will rotate smoothly and no more heat will be transmitted to the heat sensitive plate 37. Then the heat sensitive plate 37 concaves upward again thereby pushing the needle valve 33 upward to seal the opening 312.

Figure 8:
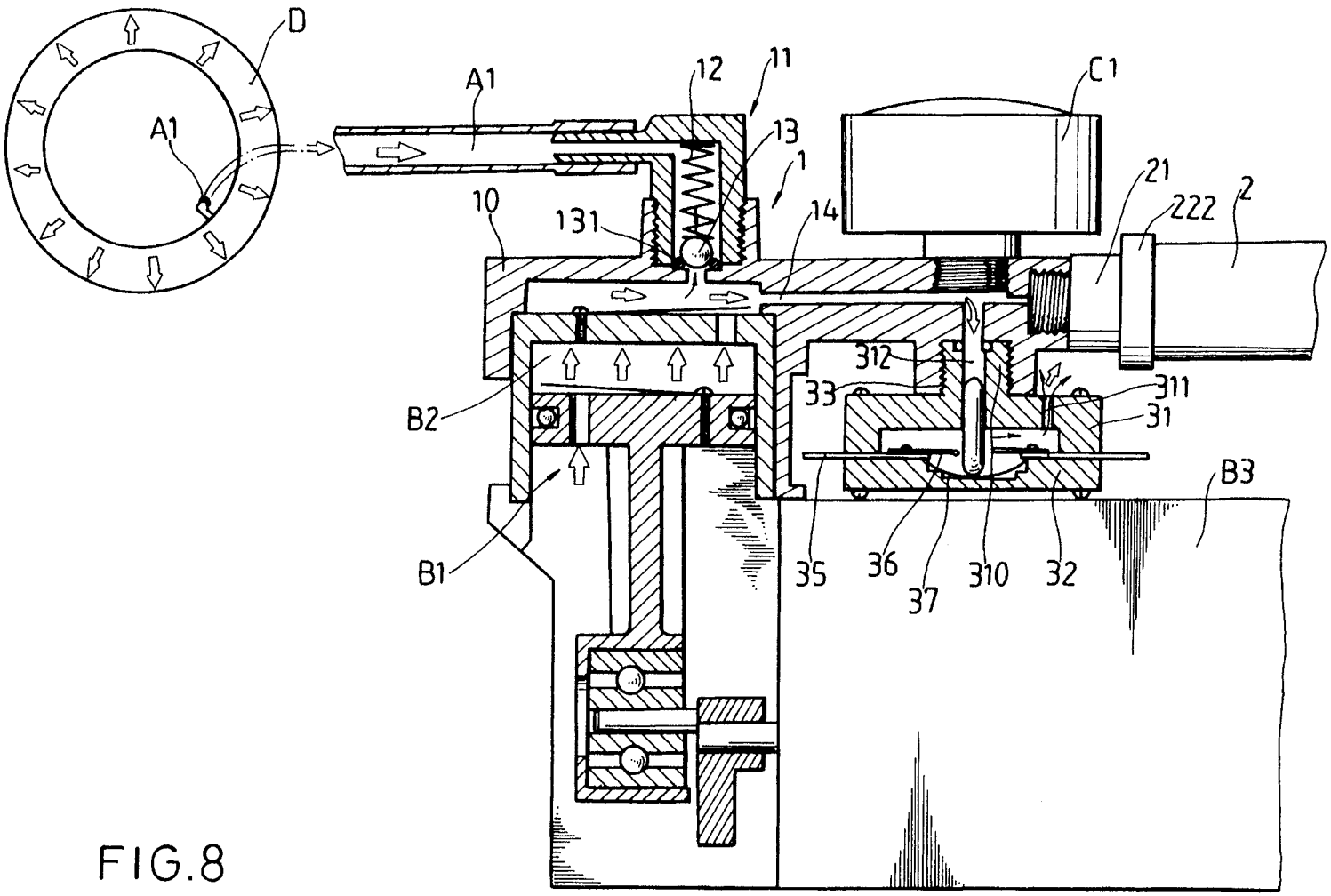
FIG. 8 shows the working principle of the present invention.

FIG. 8 shows the working principle of the present invention. As illustrated, when the nozzle A1 of the pipe A is connected with a tire D, the air pressure in the tire D will be blocked entry into the cylinder by the check valve 11. While the motor B3 rotates to drive the piston B1, an air pressure will be produced in the passage 14 and will push open the check valve 11 so that the compressed air will be applied to the tire D.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An air compressor comprising:

a valve controlling device having a check valve and a cover, said check valve being fixedly mounted on said cover and being connected with a pipe, said check valve including a spring, a ball and a packing , said spring urging said ball against said packing thereby sealing said pipe, said cover being fixedly mounted on a cylinder so that air in said cylinder can flow out of said cover, a passage being formed between said cylinder and said cover and communicated with said check valve, a power breaker, an exhaust valve, and a pressure gauge;

said power breaker fixedly connected with said cover via a connector and having an adjusting knob, a diaphragm, a main body, and two conducting members, said main body having an interior chamber in which is fitted a piston, said piston receiving a spring and having a protuberance on which is fitted a circular conductor, said spring urging said piston to go forward thereby pushing said circular conductor against said conducting members; and said exhaust valve fixedly mounted on said cover and including a thermo-couple and a needle valve, said exhausting device comprising an upper bakelite cover and a lower bakelite cover closely engaged with said upper bakelite cover, said upper bakelite cover being provided with a locking member and an air outlet, said locking member being fitted with a seal ring and formed with a hole in which is fitted said needle valve with the lower end contacting a heat sensitive member.

* * * * *